US007429163B2

(12) United States Patent
Patterson

(10) Patent No.: US 7,429,163 B2
(45) Date of Patent: Sep. 30, 2008

(54) PERFORMANCE PROPELLER

(76) Inventor: Robert S. Patterson, 16509 Satisfaction La., Church Road, VA (US) 23833

( * ) Notice: Subject to any disclaimer, the term of this patent is extended or adjusted under 35 U.S.C. 154(b) by 399 days.

(21) Appl. No.: 11/230,175

(22) Filed: Sep. 19, 2005

(65) Prior Publication Data

US 2007/0065282 A1 Mar. 22, 2007

(51) Int. Cl.
*B63H 1/26* (2006.01)

(52) U.S. Cl. ..... 416/93 A; 416/203; 416/198 R

(58) Field of Classification Search ..... 416/90 A, 416/93 A, 203
See application file for complete search history.

(56) References Cited

U.S. PATENT DOCUMENTS

| | | | | | |
|---|---|---|---|---|---|
| 746,007 | A | * | 12/1903 | Bruncker | 416/203 |
| 3,542,487 | A | * | 11/1970 | Knuth | 416/93 R |
| 3,589,833 | A | * | 6/1971 | Lancioni | 416/32 |
| 3,788,267 | A | | 1/1974 | Strong | |
| 4,212,586 | A | * | 7/1980 | Aguiar | 416/93 A |
| 4,276,036 | A | | 6/1981 | Nishida et al. | |
| 4,306,839 | A | * | 12/1981 | Pien | 416/200 R |
| 4,331,429 | A | | 5/1982 | Koepsel et al. | |
| 4,545,771 | A | | 10/1985 | Iio | |
| 4,802,872 | A | | 2/1989 | Stanton | |
| 4,871,334 | A | | 10/1989 | McCormick | |
| 5,158,433 | A | | 10/1992 | Cleary | |
| 5,549,455 | A | | 8/1996 | Speer | |
| 5,791,874 | A | | 8/1998 | Lang | |
| 5,816,869 | A | | 10/1998 | Willows | |
| 5,857,880 | A | | 1/1999 | Harada | |
| 5,916,003 | A | | 6/1999 | Masini et al. | |
| 6,010,380 | A | | 1/2000 | Wollard | |
| 6,267,634 | B1 | | 7/2001 | Ewald et al. | |
| 6,375,528 | B1 | | 4/2002 | Neisen | |
| 6,390,776 | B1 | | 5/2002 | Gruenwald | |
| 6,699,016 | B1 | | 3/2004 | Dean | |

* cited by examiner

*Primary Examiner*—Ninh H Nguyen
(74) *Attorney, Agent, or Firm*—Thomas & Raring, P.C.

(57) ABSTRACT

The invention relates to a propeller and an apparatus to modify a propeller that provide new propeller performance characteristics. In a preferred embodiment, the propeller includes two blade sets wherein the blades in the sets of distinct geometries from the blades in the corresponding set (s). In another preferred embodiment, a propeller hub ring extender is selectively secured to at least one propeller hub.

8 Claims, 3 Drawing Sheets

PERFORMANCE PROPELLER

The present invention relates, in general, to a propeller for a marine vehicle. More specifically, the propeller includes a length adjustable outer hub and optional propeller blade sets with distinct geometries.

BACKGROUND OF THE INVENTION

There is currently an unprecedented focus on the performance of propeller-based marine vehicles with particular emphasis on greater acceleration and higher top speeds. Marine vehicle owners and operators, in general, seek to increase the performance of their vehicle through tuning or modifications. A vehicle's propeller determines many performance characteristics.

Acceleration and top speed are dependent on many factors including, for instance, the power generated by the motor, the efficiency of the drive train, and the design of the hull. A consumer will typically study each of these factors when shopping for a vehicle. Once the marine vehicle is purchased, these factors are largely unchangeable or are cost-prohibitive to change.

A propeller-driven marine vehicle's performance is also largely dictated by the design and implementation of the propeller hub and propeller blades. It is thought that the propeller hub and blades are much easier to modify and upgrade than motors, drive trains and hulls.

Typically, propeller systems employ inboard or outboard motors with a drive shaft connecting the motor to a propeller hub. The drive shaft rotates the propeller hub, which in turn rotates one or more propeller blades that are formed as a part of the hub. The performance specifically attributed to the propeller hub and blades is derived from a number of factors, such as the shape of the blades, the presence of exhaust gases at the surface of the blades, the length of the outer hub, and the number of blades. Certain blade shapes provide high acceleration but low top speeds or poor mid-range acceleration while other blades might be constructed to provide just the opposite. Also, commercially available propeller hubs only contemplate propeller blades that are identically shaped. The performance of mixed-shape blade sets has not been considered. A means to selectively modify the dimensions of the propeller outer hub to affect the exit point of exhaust gases is also thought to be unknown in the prior art.

Exhaust gases produced by the motor are typically directed through the hub and, therefore, exit behind the propeller blade(s) when the marine vehicle is moving forward. Gas is much easier to displace than water. It follows then that when the blades contact gas bubbles or a gas stream the resistance to rotation is reduced, and the motor can more efficiently spin the propeller hub. Of course, at the points that the blades are in contact with gas bubbles, the blades are not displacing water, which is what propels the boat forward. It is possible for excessive gas bubbles or a gas stream to cause the propeller blades to "break loose." This effect is not unlike a motor vehicle spinning its tires when the acceleration force on the tires exceeds the tires' maximum surface grip. Basically, it becomes easier for the motor to spin the tires once the breaking point has been reached but acceleration suffers. The same basic principle can be applied to marine propellers.

Propeller and boat builders have been known to try to find a medium between facilitating the rotation of the propeller at low speeds while maximizing acceleration. As such, exhaust gases have been known to be purposefully introduced to the blade surfaces by providing exhaust ports upstream of the blades.

The length of the outer hub also plays a role. With short propeller outer hubs, the exhaust gases exit the hub in such a way as to interact with the surfaces of the blades. Longer outer hubs can reduce or eliminate this interaction. Because all of the above performance factors are largely interrelated, the ideal outer hub length can vary between boats. Some boats will perform better with longer outer hubs than others, and vice versa. Currently, a boat owner can only modify this aspect of their vehicles performance by replacing the propeller.

There is a need for an apparatus and method to readily adjust the length of a propeller outer hub without actually replacing the propeller altogether. In addition, consumers desire a propeller hub with blade sets that provide distinct geometries in order to increase the propeller's performance characteristics across the propeller's operating range. An adjustable length propeller outer hub and propeller blade sets with distinct geometries in accordance with the present invention provide new propeller tuning and modification options.

SUMMARY OF THE INVENTION

In accordance with the present invention, an adjustable length propeller outer hub and a propeller hub with mixed-shape propeller blade sets and related methods are provided. The propeller outer hub provides increased and/or modifiable performance from a propeller. The propeller, used to transfer a motor's energy into forward motion for a marine vehicle, includes an outer hub extender ring that is selectively secured to a propeller barrel or hub. In addition, the propeller's blades can comprise at least two blade sets wherein the blades in the corresponding sets have distinct geometries.

A propeller outer hub is generally a substantially cylindrical body with an internal exhaust gas passageway. Propeller blades are secured to, or integrated with, the outer surface of the hub. A motor drives the hub in order to rotate the propeller blades. The motor produces exhaust gases which at least partially pass through the propeller hub to be expelled downstream of the propeller blades (assuming forward motion of the marine vehicle).

In a preferred embodiment of the present invention, the outer hub length adjustable via an extender ring. The exhaust end of the hub would include internal threads. The ring provides threads that engage the hub's internal threads in order to secure the ring to the hub. The outer diameter of the ring will be substantially the same as the hub's outer diameter. Other means for securing the ring to the hub, ring shapes, and the like would be obvious to one skilled in the art.

In another preferred embodiment of the propeller, the propeller's blades would consist of at least two distinctly shaped propeller blade sets wherein each set includes one or more blades. The mismatched shapes provide differing performance characteristics over the marine vehicles operating range. Specific blade shapes could be paired to provide specific performance enhancements. The specific shapes employed will depend on the vehicle and the desired performance characteristics.

An adjustable length propeller outer hub with mixed-shaped propeller blade sets in accordance with the present invention efficiently addresses various problems associated with prior art propellers. The propeller apparatus and related method(s) comprise a commercially advantageous product. A propeller in accordance with the present invention provides modifiable performance advantages. The foregoing, and additional objects, features, and advantages of the present invention will become apparent to those of skill in the art from the following detailed description of at least one preferred embodiment thereof, taken in conjunction with the accompanying drawings.

DETAILED DESCRIPTION

The method and apparatus for the length adjustable propeller outer hub and propeller hub blades of distinct geometries of the present invention efficiently address one or more shortcomings of the prior art. The present propeller is adaptable to provide varying performance characteristics. FIGS. 1 through 4C illustrate one or more preferred embodiments of the present invention. Naturally, an engineer having ordinary skill with the assembly of propellers will be able to create a propeller that incorporates the teachings of the present invention, but which may look different and incorporate different, alternative parts.

Figure 1:
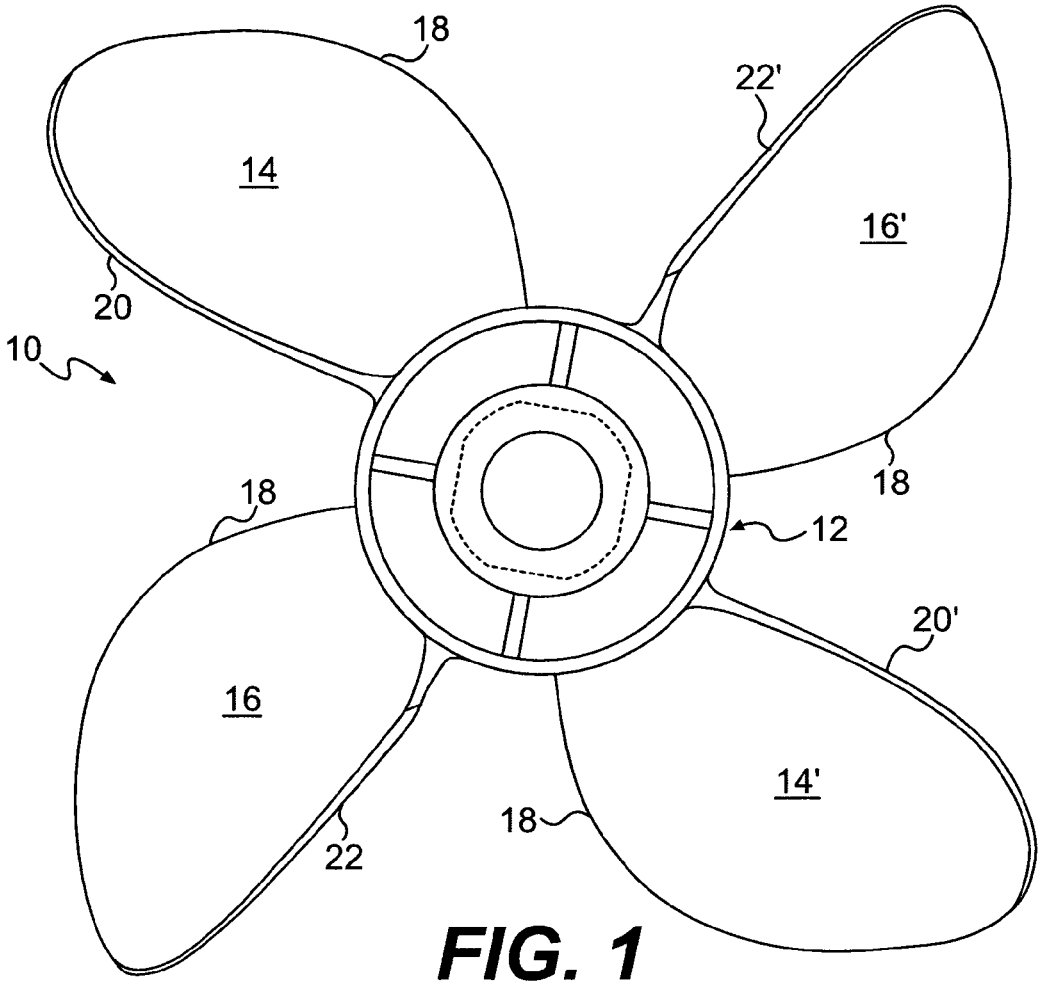
FIG. 1 is a view of the exhaust end of a propeller outer hub with two blade sets of distinct geometries in accordance with one embodiment of the present invention.

Turning now to FIG. 1, there is illustrated a propeller 10 comprising a cylindrical propeller hub 12 and propeller blades. The view of FIG. 1 is from the perspective of examining the rear/exhaust end of the propeller. In practice, the opposite end of the propeller would be mated to an engine housing. The engine is in mechanical connection with the propeller in order to cause the rotation of the propeller, as is known in the art.

In general, propeller makers control a number of propeller characteristics that have an impact on performance. Propeller makers can vary the blade pitch, blade diameter, propeller ventilation, blade cupping, blade rake (or camber), the number of blades on the propeller, and the like. A typical propeller will be constructed so that each blade on the propeller is identical in every respect. However, each blade design presents inherent compromises that directly, negatively affect one or more performance characteristics of the propeller. In other words, one blade design may provide slow acceleration from a stop while providing a high top speed while another blade design may lower the top speed while offering a relatively high acceleration. Obviously, other combinations of performance characteristics are possible. For instance, some blades are geared towards "midrange" performance. The numerous factors considered during propeller blade designing or tuning provide a significant range of design choices. Each design choice has some impact on performance.

Another complicating factor in propeller construction or tuning is that no one propeller will be the optimum propeller for a range of marine vehicles. Each boat, even boats of similar sizes and construction, will perform differently based on trim levels, number of passengers, engine performance and tuning, and so forth when mated with any one propeller design.

In this illustrated embodiment, in contrast to typical propeller constructions, there are two sets of propeller blades. The first set includes a first pair of blades 14, 14'. The second set includes a second pair of blades 16, 16'. Every propeller blade has a leading edge and a trailing edge. The leading edge is considered the foremost edge of each propeller blade. Here, the leading edge of each blade is identified as element 18. In this preferred embodiment, leading edge 18 is substantially identical on each blade. The particular rounded shape of leading edge 18 in FIG. 1 is known as a lobed leading edge.

The rear edge of a propeller blade is commonly referred to as the trailing edge. The leading edge transitions to the trailing edge at the point on the blade that is furthest from hub 12. The trailing edges in the illustrated preferred embodiment are different for each set of blades. First blades 14, 14' include a semi-lobed trailing edge 20, 20'. The semi-lobed shape is defined by the fact that leading edge 18 does not continue along a continuous arc as it transitions to trailing edge 20, 20'. More specifically, trailing edge 20, 20' has a smaller arc angle adjacent to the transition point than the arc angle defined by leading edge 18. The shape of first blades 14, 14' can be referred to as a semi-lobed blade.

Second blades 16, 16' also include lobed leading edge 18 but have a semi-cleavered trailing edge 22, 22'. The semi-cleavered shape is defined by the fact that leading edge 18 has a relatively radical transition to trailing edge 22, 22'. If the transition point defined a substantially sharp point, the trailing edge might be referred to as a cleavered or fully cleavered tailing edge. Because trailing edges 22, 22' have a rounded transition to leading edge 18, second blades 16, 16' are considered to be semi-cleavered. In this preferred embodiment, it can be appreciated that semi-cleavered trailing edges 22, 22' display a sharper transition to leading edge 18 than the transition from leading edge 18 to trailing edge 20, 20' provided by first blades 14, 14'.

The specific blade shape and tuning characteristics, including blade pitch, blade diameter, propeller ventilation, blade cupping, blade rake, the number of blades on the propeller, and the like, can be varied for each blade set as desired. It is the combination of two distinct blade geometries on a single propeller that is thought to provide a performance advantage throughout the operating range of the propeller. The two shapes, in effect, compliment each other so that the performance advantages offered by either blade shape can be realized while minimizing the performance disadvantages inherent to either blade shape. Again, one skilled in the art will appreciate that there are alternative blade shapes that might be combined as contrasting blade sets on a single propeller in order to provide performance advantages. A blade set, for the purposes of this invention, will be one or more blades on a propeller that are not identically shaped to a blade in another blade set on that propeller.

Another aspect of propeller construction is the proper balancing of the propeller hub. It is understood that a single propeller blade would be the most efficient form of a propeller. However, a single blade makes it difficult or impossible to balance the balance the hub. Extra mass and resistance is placed on only one side of the hub. It is more common to provide a blade layout on the hub that offers counteracting forces to balance the propeller. Therefore, where there are only two blades, the blades are positioned at opposite (180 degree) points on the surface of the cylindrical hub. A three-blade propeller would have blades positioned at or near 120 degrees of separation on the hub. Four blades would be positioned every 90 degrees on the surface of the hub. One of skill in the art will appreciate that can be achieved for a plurality of blades. While the illustrated preferred embodiment includes four blades, it is envisioned that any plurality of blades would be suitable to perform the present invention.

Also illustrated in FIG. 1, but not labeled, is the internal support structure of a propeller hub. Typically, there is an inner hub mated to the drive shaft that connects the propeller to an engine (not shown). There is a central exhaust passageway and spokes that structurally support and/or connect the inner hub to outer hub 12. The internal hub and ribs are components that are generally known in the art. It is envisioned that an extender may be applied to the inner hub, if desirable.

Figure 2:
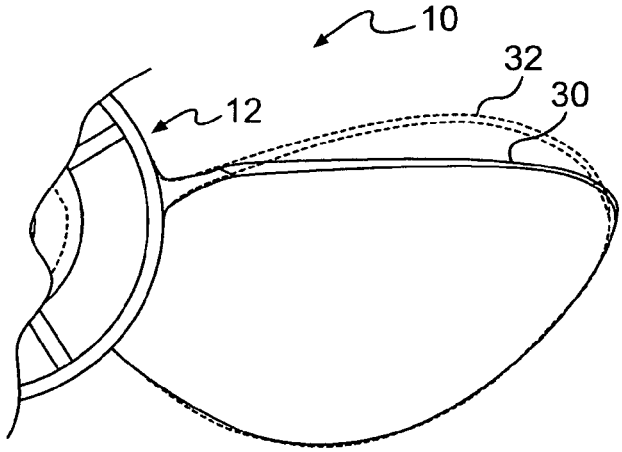
FIG. 2 is an overlay view of the blades of FIG. 1.
Figure 3:
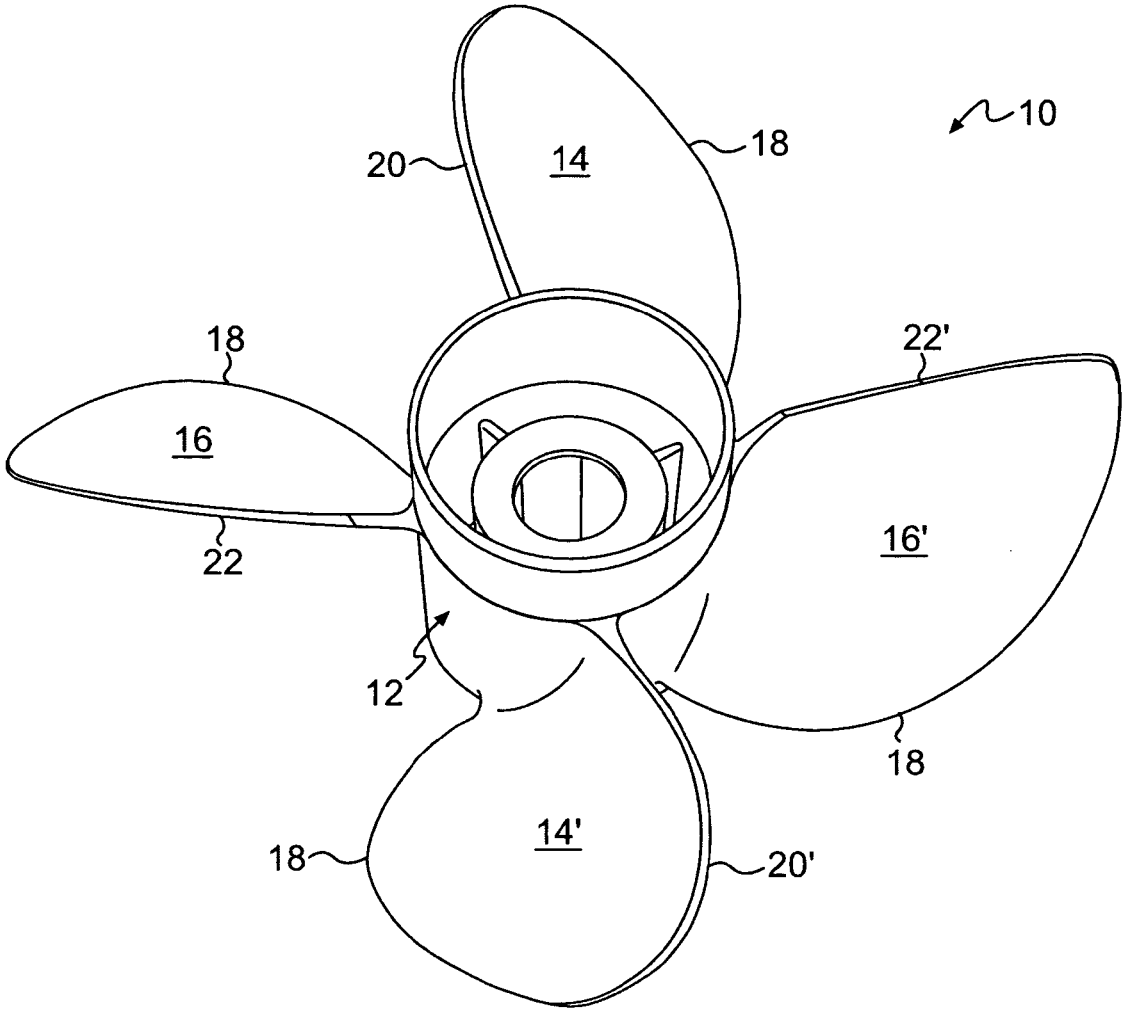
FIG. 3 is a perspective view of an extendable propeller outer hub in accordance with one embodiment of the present invention.

FIG. 2 provides a comparison view of the blades described above and illustrated in FIG. 1. A semi-cleavered trailing edge 30 is contrasted with a semi-lobed trailing edge 32. As illustrated, it is obvious that a semi-lobed blade would offer an increased surface area, which would displace more water than the semi-cleavered blade. On the other hand, the semi-cleavered blade has an increased diameter (i.e., the distance across a circle at the extreme tips of the blades). A larger diameter generally produces extra drag, but the semi-cleavered shape facilitates increased rotation acceleration. Again, alternate blade shapes are available. The choices of combining two blade sets will, in part, be determined by the specific performance gains a skilled artisan is seeking to accomplish.

Figure 4A:
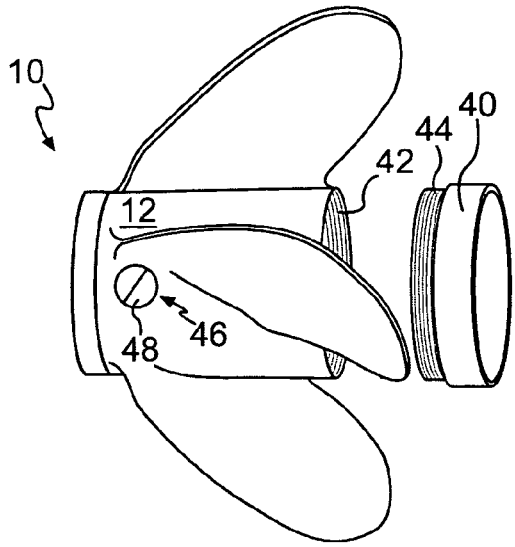
FIG. 4A is a side view of a propeller with a propeller extension ring in a spaced relationship to the propeller in accordance with one embodiment of the present invention.
Figure 4B:
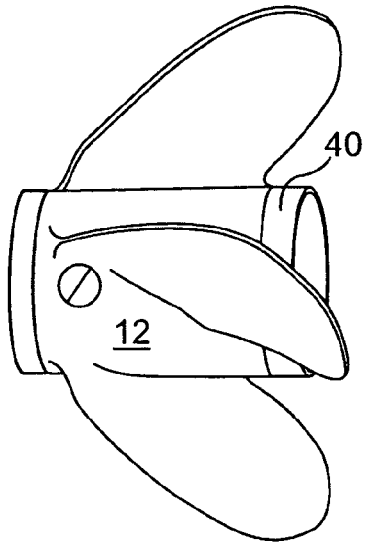
FIGS. 4B is a side view of a propeller with a propeller extension ring secured to the hub in accordance with one embodiment of the present invention.
Figure 4C:
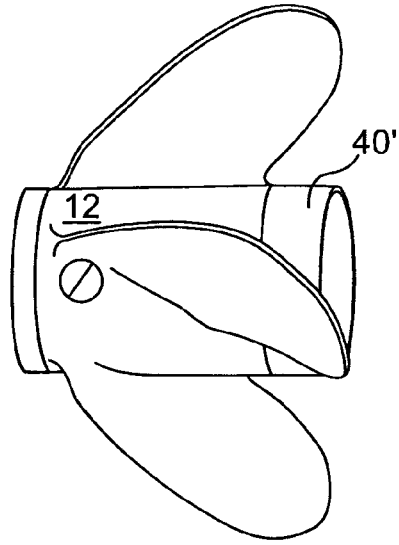
FIG. 4C is a side view of a propeller with a propeller extension ring secured to the hub in accordance with yet another embodiment of the present invention.

In FIGS. 4A-4C, propeller 10 is illustrated with an outer hub ring extender 40 that is operable to selectively modify the length of outer hub 12. In FIG. 4A, extender 40 is in a spaced relationship with the rear opening of propeller 10. Ring 40 is threaded to engage corresponding threads provided by the hub. The ring is cylindrically shaped to act as an extension of hub 12. Therefore, ring 40 includes an opening to allow motor exhaust passing through hub 12 to be expelled to the rear of ring 40.

In more detail, the rear opening of hub 12 includes internal threads 42. Internal threads 42 mate with male threads 44 on the extender. The outer diameter of ring 20 and hub 12 is substantially the same. The outer diameters do not have to be identical, and the specific shape of ring 40 can be altered to provide specific performance characteristics.

A plurality of exhaust ports 46 may be included in hub 12. Ports 46 can include a plug 48, as known in the art. With the plug in place, exhaust gases are vented only to the rear of propeller 10. Removing the plugs permits exhaust gas to exit propeller 10 upstream of the blades. Other types of plugs and exhaust ports are known and should be obvious to one of skill in the art.

Turning to FIG. 4B, ring 40 is illustrated as secured to hub 12. Exhaust gas exiting hub 12 will generally interact with the blades during forward or backward motion of the marine vehicle. The effect of this interaction is described above. The amount of the effect can be controlled or eliminated by altering the length of the hub to be either longer or shorter.

In FIG. 4C, a ring 40' is provided that is longer than ring 40 in FIG. 4B. The marine vehicle operator or owner can attach different size rings based on the level or type of performance characteristics desired. Because performance characteristics are interrelated to other marine vehicle characteristics, a marine vehicle owner can substitute or evaluate various extender ring sizes in order to achieve the performance modifications that best suit their expectations or vehicle.

Although the present invention has been described in terms of a preferred embodiment, it will be understood that numerous variations and modifications may be made without departing from the invention. Thus, for example, the propeller blades and extender ring can take numerous shapes other than the generally semi-lobed, semi-cleavered, and cylindrical shape that are illustrated. The extender ring and blades can also be formed from numerous materials suitable for marine propeller systems. The ring can be fastened to a propeller hub by other fastening mechanisms than the threaded connection. It is possible that a user desire to permanently connect the ring through some mechanism such as bonding, welding, screws or the like.

Additional embodiments will become apparent to one skilled in the art. Thus, it is to be understood that within the scope of the appended claims, the invention may be practiced otherwise than as specifically described above.

What is claimed is:

1. A propeller for a marine vehicle, comprising:

a cylindrical hub with a first end and a second end, said hub including at least one opening at the first and second ends;

a passageway from the least one opening at the first end to the at least one opening at the second end;

a plurality of propeller blades, the plurality of blades comprising a first set of blades comprising a semi-lobed blade shape and a second set of blades comprising a semi-cleavered blade, the shape of the first set of blades being distinct from the shape of the second set of blades; and a cylindrically-shaped extender ring selectively secured to one end of the hub, the extender ring operable to modify the length of the cylindrical hub, the extender ring being free of any inwardly projecting structural elements.

2. The propeller of claim 1, wherein the at least one opening at the first end is an exhaust intake opening and the at least one opening at the second end is an exhaust outlet opening.

3. The propeller of claim 1, wherein the extender ring is selectively secured to the hub via interlocking threads on the hub and ring.

4. A propeller for a marine vehicle, comprising:

a cylindrical hub with a first end and a second end, said hub including at least one opening at the first and second ends;

a passageway from the least one opening at the first end to the at least one opening at the second end; and a plurality of propeller blades, the plurality of blades comprising a first set of blades comprising a semi-lobed blade shape and a second set of blades comprising a semi-cleavered blade, the shape of the first set of blades being distinct from the shape of the second set of blades.

5. The propeller of claim 4, wherein the at least one opening at the first end is an exhaust intake opening and the at least one opening at the second end is an exhaust outlet opening.

6. The propeller of claim 4, further comprising an extender ring selectively secured to the hub.

7. The propeller of claim 6, wherein the extender ring operable to modify the length of the cylindrical hub.

8. The propeller of claim 7, wherein the extender ring is selectively secured to the hub via interlocking threads on the hub and ring.

* * * * *